US007891340B2

(12) United States Patent
Surnilla et al.

(10) Patent No.: US 7,891,340 B2
(45) Date of Patent: Feb. 22, 2011

(54) FEED-FORWARD CONTROL IN A FUEL DELIVERY SYSTEM AND LEAK DETECTION DIAGNOSTICS

(75) Inventors: Gopichandra Surnilla, West Bloomfield, MI (US); David George Farmer, Plymouth, MI (US); Davor David Hrovat, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 157 days.

(21) Appl. No.: 12/113,078

(22) Filed: Apr. 30, 2008

(65) Prior Publication Data

US 2009/0276141 A1 Nov. 5, 2009

(51) Int. Cl.
*F02D 41/06* (2006.01)
*F02M 37/04* (2006.01)

(52) U.S. Cl. ..... 123/457; 123/179.17; 123/504; 701/113

(58) Field of Classification Search ..... 123/179.17, 123/198 D, 456, 491, 495, 500–503, 512
See application file for complete search history.

(56) References Cited

U.S. PATENT DOCUMENTS 5,515,831 A 5/1996 Yonekawa
5,715,786 A * 2/1998 Seiberth ..... 123/198 D
5,927,253 A * 7/1999 Oyafuso et al. ..... 123/456
6,389,901 B1 * 5/2002 Joos et al. ..... 73/714
6,659,085 B2 12/2003 Kojima
6,715,470 B2 * 4/2004 Takahashi ..... 123/458
6,986,341 B2 * 1/2006 Mitani et al. ..... 123/520
7,121,265 B2 * 10/2006 Joos et al. ..... 123/494
7,318,421 B2 * 1/2008 Fukasawa ..... 123/491
7,337,652 B2 * 3/2008 Shamine ..... 73/40
7,650,779 B2 * 1/2010 Puckett et al. ..... 73/114.41

FOREIGN PATENT DOCUMENTS

EP 1321664 6/2003
JP 6146984 5/1994

* cited by examiner

*Primary Examiner*—Stephen K Cronin
*Assistant Examiner*—David Hamaoui
(74) *Attorney, Agent, or Firm*—Allan J. Lippa; Alleman Hall McCoy Russell & Tuttle LLP

(57) ABSTRACT

A method for operating a fuel delivery system with a first pressure pump fluidly coupled to a second higher pressure pump is described. In one example, the fuel pumps are adjusted based on measured fuel pressure during a first condition. The fuel pumps are adjusted independent of the measured fuel pressure during a second condition.

20 Claims, 8 Drawing Sheets

FEED-FORWARD CONTROL IN A FUEL DELIVERY SYSTEM AND LEAK DETECTION DIAGNOSTICS

BACKGROUND

Fuel delivery systems in internal combustion engines may experience various conditions in which vapors may form in the fuel lines. For example, fuel delivery systems may experience leaks in which ambient air enters the fuel delivery system. Likewise, fuel vapors may form at increased temperatures.

One approach to deal with vapor formation is described in JP 06-146984. In this system, a fuel pressure detected by a fuel pressure sensor is stored at the time of starting. A deviation between a fuel pressure, after a period of time elapses, and the initial fuel pressure is determined. The deviation is corrected according to the initial fuel pressure and a power source voltage of a fuel pump. Then, the amount of vapor is estimated based on the corrected deviation, and the correction of fuel pressure and injection pulse width is provided.

The inventors herein have recognized a disadvantage with such an approach. In particular, in direct injection systems utilizing a first, lower pressure, and second, higher pressure, fuel pump, the initial fuel pressure at starting may not correctly identify fuel vapor generation. Further still, such an approach may not properly identify and/or differential leaks from vapor formation.

As such, in one approach, a method for operating a fuel delivery system with a first pressure pump fluidly coupled to a second higher pressure pump and a fuel rail may be used. The method includes adjusting pump operation of at least one of the first and second pumps during engine starting, the adjustment based on engine starting conditions. When pressure rise during the start is correlated to an expected response, the method further includes adjusting pump operation independent of the measured fuel pressure, and when pressure rise during the start is less than the expected response, the method further includes adjusting pump operation based on the measured fuel pressure.

In this way, it is possible to accurately and robustly respond to various engine starting situations including vapor formation, leaks, etc. For example, when the pressure rise correlates to an expected response, one or both of the pumps may be adjusted during the start, based on the measured pressure, to provide improved control operation and better consistency in injection pressure for a first or subsequent injection. Alternatively, when the pressure rise is below the expected response, one or both pumps may be adjusted independent form the measured pressure, since the pressure measured may not provide an accurate indication of injection operation. Thus, the effects of vapor formation and/or leaks may be mitigated.

FIGURES

DETAILED SPECIFICATION

Figure 1:
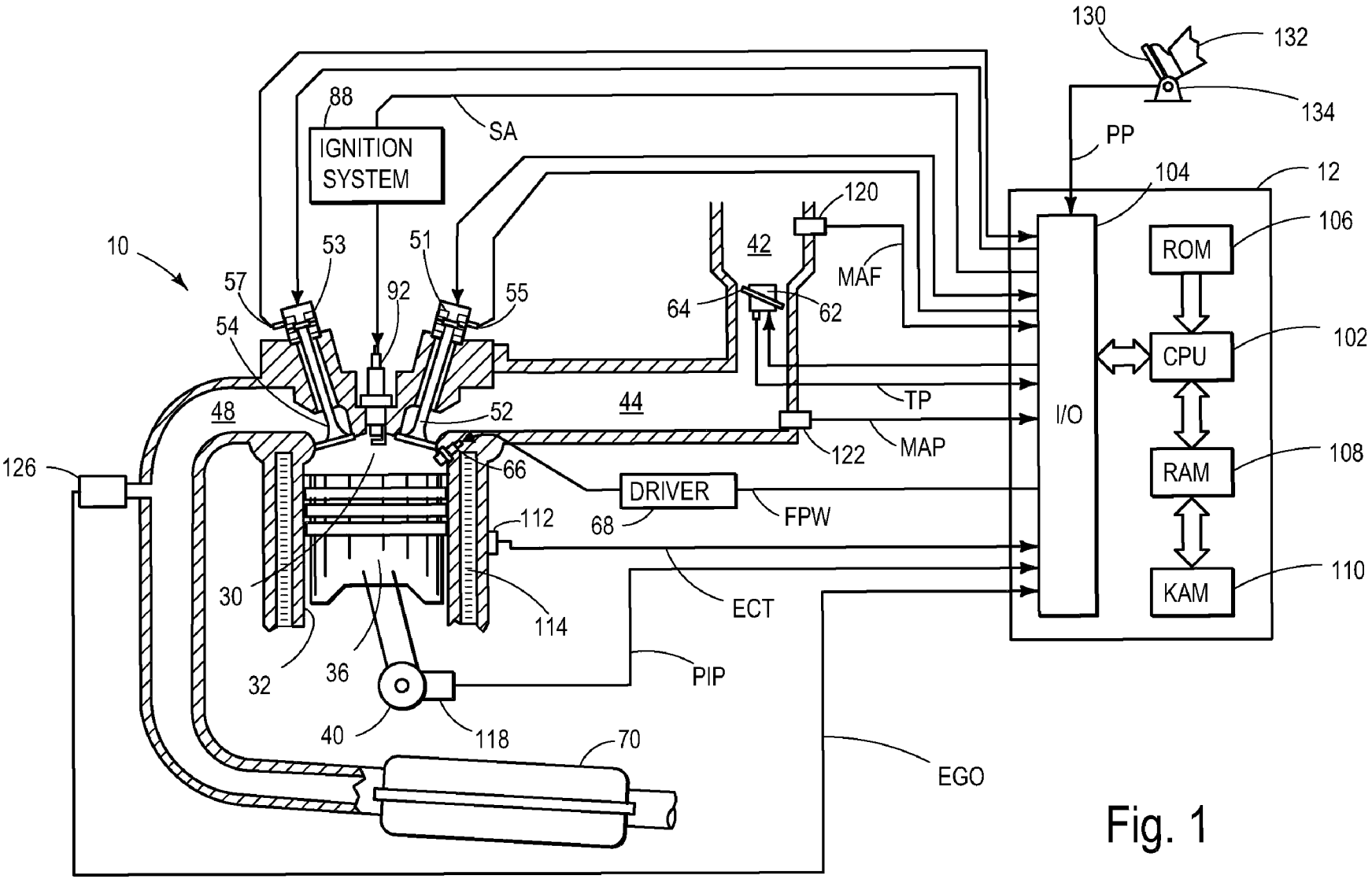
FIG. 1 shows a schematic depiction of an internal combustion engine.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via electric valve actuator (EVA) 51. Similarly, exhaust valve 54 may be controlled by controller 12 via EVA 53. During some conditions, controller 12 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a suitable fuel delivery system. For example, the fuel delivery system shown in FIG. 2A or FIG. 2B may be coupled to fuel injector 66. In some embodiments, combustion chamber 30 may alternatively or additionally include a fuel injector arranged in intake passage 44 in a configuration that provides what is known as port injection of fuel into the intake port upstream of combustion chamber 30.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

As described above, FIG. 1 shows only one cylinder of a multi-cylinder engine, and that each cylinder may similarly include its own set of intake/exhaust valves, fuel injector, spark plug, etc.

Figure 2A:
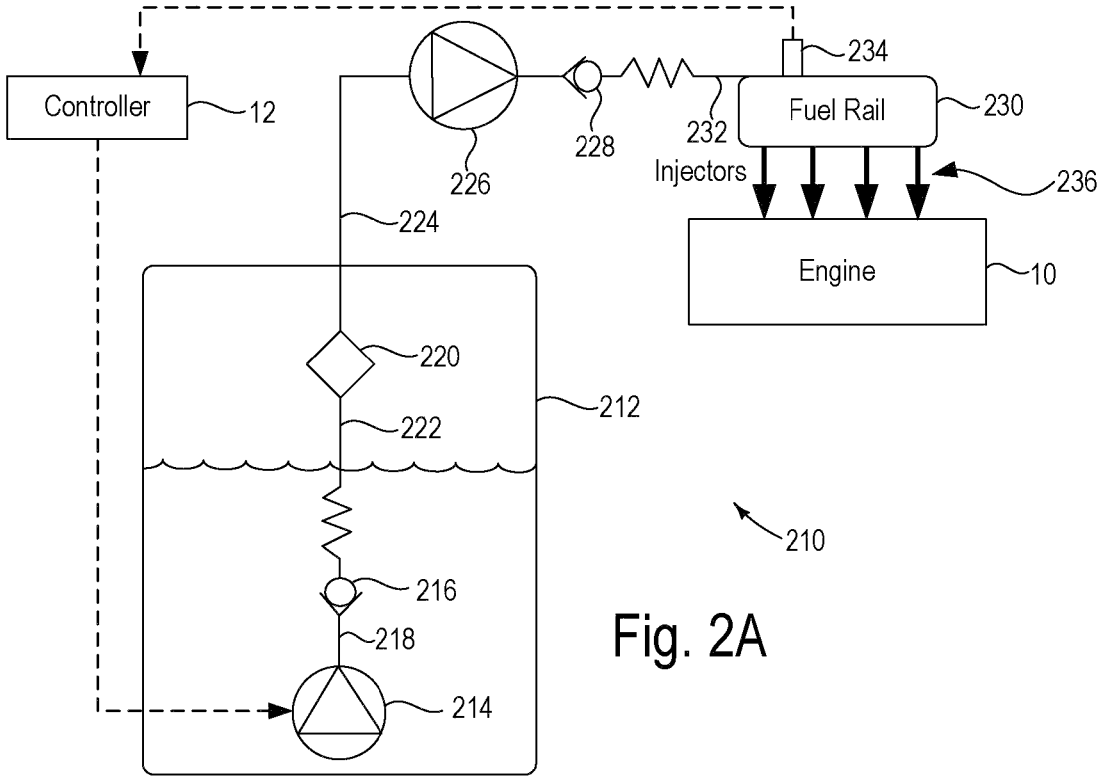
FIG. 2A shows a schematic depiction of fuel delivery system for an internal combustion engine.
Figure 2B:
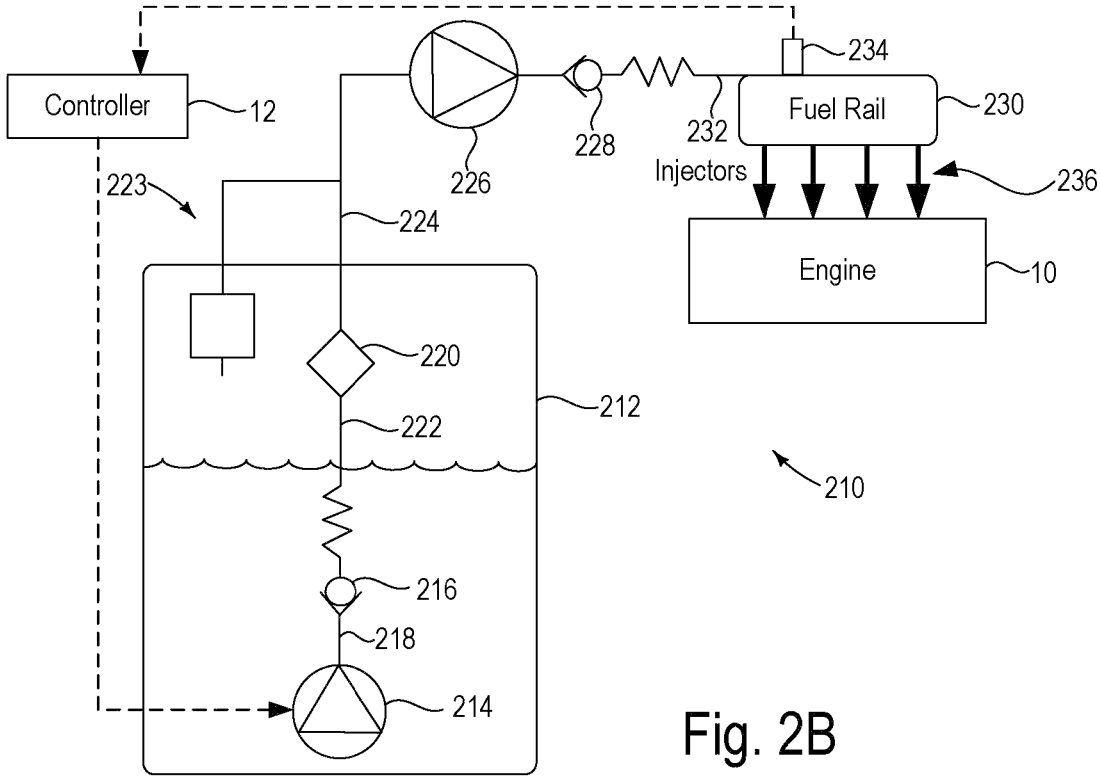
FIG. 2B shows an additional schematic depiction of a fuel delivery system for an internal combustion engine.

FIG. 2A shows a diagram of the fuel delivery system 210 that may be used in the internal combustion engine shown in FIG. 1. The fuel delivery system may be operated to provide engine 10 with various amounts of fuel at various pressures. The operation of the fuel delivery system and engine, specifically fuel delivery system diagnostic algorithms, are discussed in more detail herein. The fuel delivery system may include a fuel tank 212 substantially surrounding a lower pressure fuel pump 214. In some examples, the lower pressure fuel pump 214 may be an electronically actuated lift pump. In other examples, fuel pump 214 may be another suitable fuel pump capable of delivering fuel at a higher pressure to downstream components pump, such as a rotodynamic pump, a mechanically actuated positive displacement pump, or various others. Low pressure fuel pump 214 may be actuated by a command signal sent from controller 12. In some examples a fuel pressure regulator FPR (not shown) electronically coupled between the controller and the lower pressure fuel pump 214, preventing the pressure downstream of the FPR from becoming too large and possibly damaging downstream components. In further examples, a pulse control module PCM (not shown) may control the actuation of pump 214.

The lower pressure pump may be fluidly coupled to a check valve 216 by fuel line 218. Check valve 216 may allow fuel to travel downstream and impedes fuel from traveling upstream when there is a sufficient pressure differential. Check valve 216 may be fluidly coupled to a fuel filter 220 by fuel line 222. In one embodiment, shown in FIG. 2B, a return-less fuel circuit 223 may be added to the fuel delivery system, coupled downstream of the fuel filter. The return-less fuel circuit may decrease the amount of fuel re-circulated into the fuel tank while allowing the pressure downstream of the device to increase when the fuel injectors are not delivering fuel to the cylinders.

Again referring to FIG. 2A, a fuel line 224 may extend out of the fuel tank fluidly coupling the fuel filter and a higher pressure pump 226. In some examples, the higher pressure pump is operably coupled to crankshaft 40, shown in FIG. 1, allowing the higher pressure pump to be mechanically actuated by the engine. In other examples, the higher pressure pump is electronically actuated. The timing strategy used to control the actuation of the higher pressure pump as well as the lower pressure pump is discussed in more detail herein.

The higher pressure pump may be fluidly coupled to check valve 228. Check valve 228 may be fluidly coupled to a fuel rail 230 by fuel line 232. A pressure sensor 234 may be coupled to the fuel rail. Pressure sensor 234 may be electronically coupled to controller 12 and configured to measure the pressure in the fuel rail. The fuel rail may be fluidly coupled to a plurality of injectors 236. The injectors may be configured to deliver fuel to engine 10. It can be appreciated by a person skilled in the art that other variations of this fuel delivery system may be utilized to improve the performance of the fuel delivery system.

The mechanical actuation of the higher pressure pump may occur at the beginning of crank during normal operation of the engine. Normal operation of the engine includes any time when the engine is producing torque. The actuation of the higher pressure pump may only occur at certain time intervals due to the mechanical system associated with the higher pressure pump. A timing diagram of a specific timing of actuation is shown in FIG. 5A, FIG. 5B, FIG. 6A, and FIG. 6B, discussed in more detail herein. In further examples, the higher pressure pump is electronically actuated, thereby allowing actuation of the pump to occur before the engine produces torque.

A portion of method 400, discussed in more detail herein, under some conditions may require implementation between two fuel injections, allowing for accurate measurement of the fuel rail pressure. Under some conditions the injection timing and/or profile may be altered to allow the pump stroke of the higher pressure pump to occur between two fuel injections. A fuel injection may include the event when a fuel injector has been actuated and is delivering fuel to a cylinder and/or intake manifold.

Figure 3:
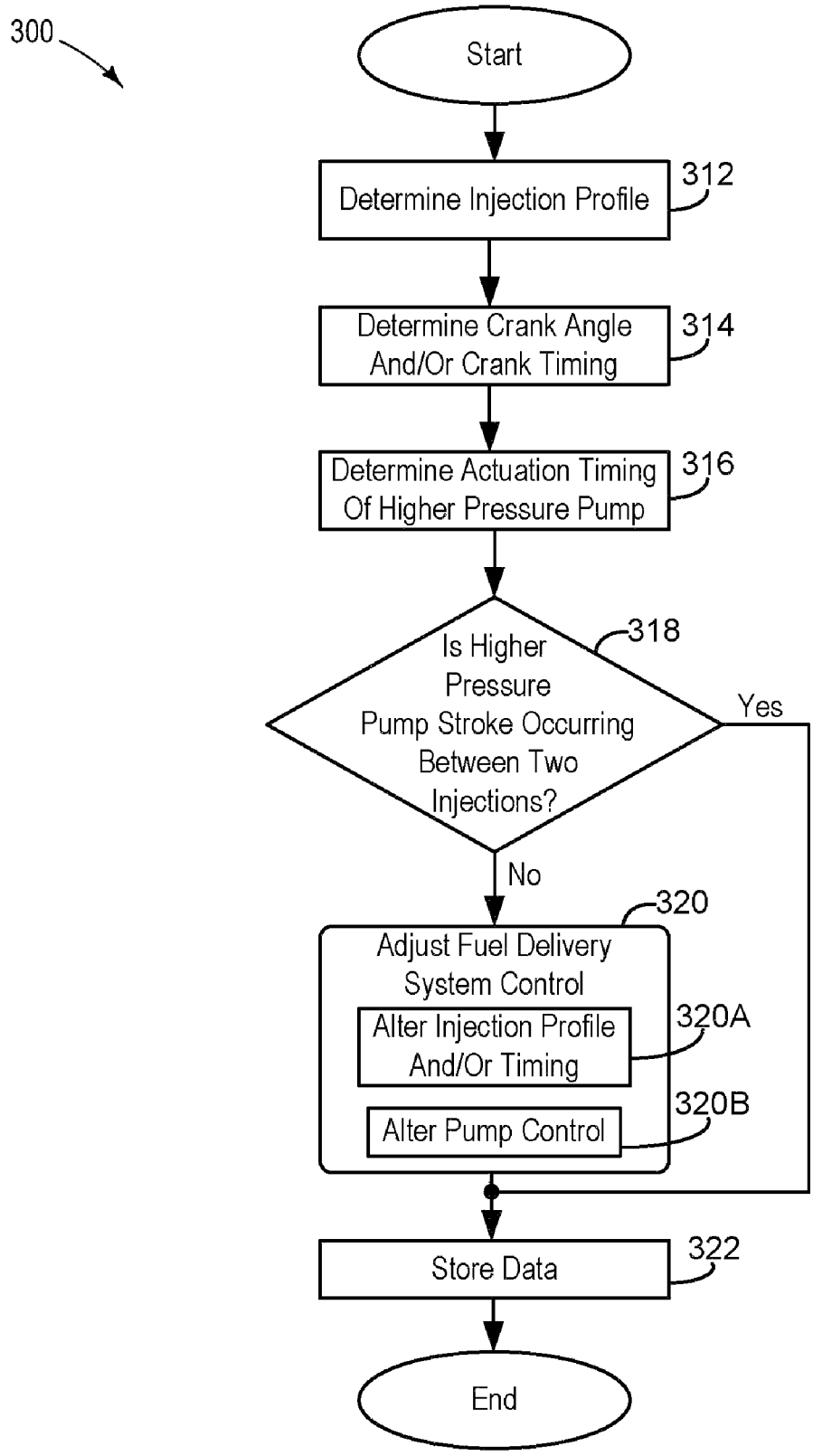
FIG. 3 shows a flow chart that may be used to adjust the timing of the fuel injection pulses and/or the actuation of the higher pressure pump.

FIG. 3 shows a routine 300 that may be implemented as part of method 400, described in more detail herein, to verify that the high pressure fuel pump stroke is occurring between two fuel injections, allowing for accurate measurement of the pressure in the fuel delivery system. Routine 300 may be implemented during cranking or engine starting. However because of the characteristics of the fuel delivery system during engine starting routine 300 may not need to be implemented. Additionally, routine 300 may be performed during normal operation of the engine after start up. It may be desirable to measure the fuel rail pressure when there is a high pressure in the fuel rail. For example, after a pump stroke of the higher pressure fuel pump has occurred, allowing the fuel and/or air vapor in the fuel system downstream of the higher pressure pump to absorb into the liquid fuel. However, when a fuel injection occurs during a higher pressure pump stroke the pressure in the fuel rail may decrease and fuel and/or air vapor may develop in the fuel rail. It may be beneficial to adjust the fuel injection timing, the fuel injection profile, and/or the timing of actuation of the higher pressure pump, allowing for an accurate pressure measurement in the fuel rail. In other examples, the pressure downstream of the higher pressure fuel pump may be measured.

At 312 the fuel injection profile is determined. In some examples, the profile is adjusted to deliver the desired amount of fuel to the cylinders, which may be determined by an air fuel feed-back control system. In other examples, other suitable means of determining the amount of fuel injected into the cylinders may be used.

Next at 314, the crank angle and/or crank timing is determined. In some examples, the crank angle and crank timing is determined by Hall-effect sensor 118. In other examples, another suitable sensor may be used to measure the crank angle.

The routine then proceeds to 316, where the actuation timing of the higher pressure fuel pump is established. In some example, the flowrate of the higher pressure fuel pump is determined by a feed-back control type system used for the fuel delivery system.

The routine then advances to 318, where it is determined if the pump stroke of the higher pressure fuel pump is occurring between two fuel injections. If it is determined that the pump stroke of the higher pressure fuel pump is occurring between two fuel injections, the routine then proceeds to 322, where the fuel pulse width, fuel injection timing, and/or actuation timing of the higher pressure pump is stored. In other examples, in step 318, it may be determined if the high pressure fuel pump stroke will occur between two fuel injections. In some examples, the data may be stored in the controller. The stored fuel injection timing and/or actuation timing of the higher pressure pump may be used for subsequent engine cycles, during which time method 400 can be implemented. The routine then ends.

On the other hand, if the pump stroke of the higher pressure fuel pump occurs between two fuel injections, the routine proceeds to 320 where the fuel delivery system control is adjusted. Adjusting the air/fuel control may include: altering the injection profile and/or timing at 320A and/or altering the control of one or more fuel pumps at 320B.

Figure 5A:
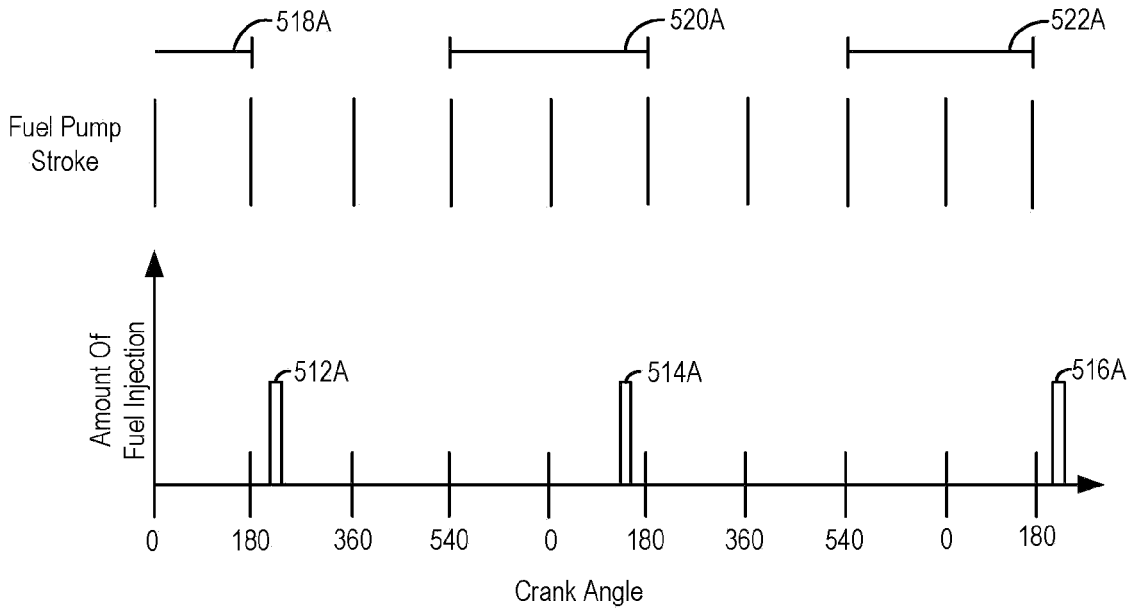
FIG. 5A shows a timing diagram of actuation of a fuel pump and injection profile for an internal combustion engine where a higher pressure pump stroke occurs during an injection pulse.
Figure 5B:
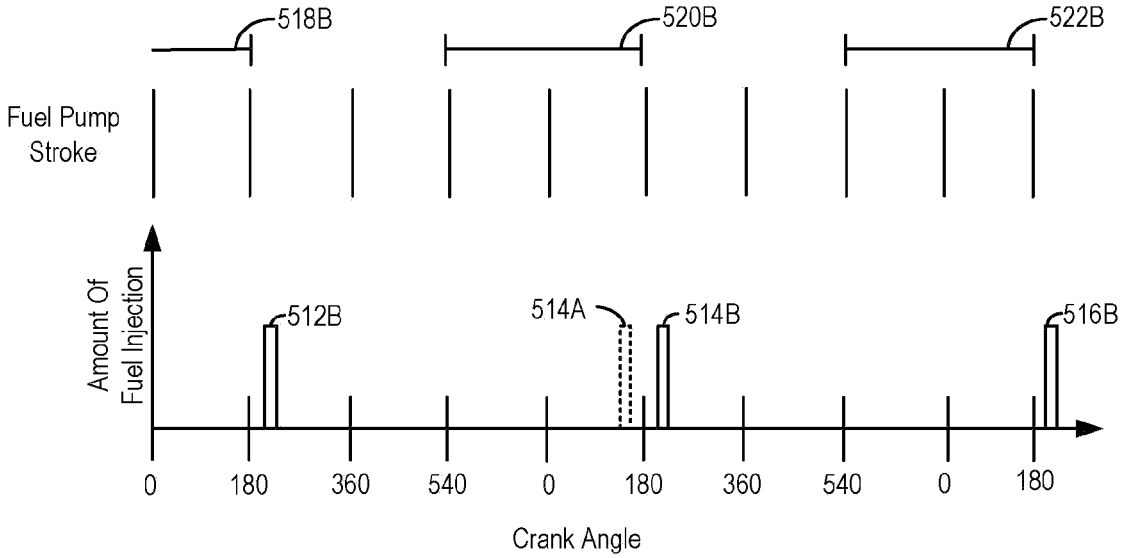
FIG. 5B shows a timing diagram where the timing of the injection pulse is adjusted, allowing a higher pressure pump stroke to occur between fuel injection pulses.

After the air/fuel control is adjusted, the routine advances to 322. The timing charts, shown in FIG. 5A and FIG. 5B, further illustrate how the injection timing may be adjusted to allow the high pressure fuel pump stroke to occur between fuel injections. FIG. 5A shows fuel injection pulses 512A, 514A, and 516A as well the duration of the higher pressure fuel pump stroke 518A, 520A, and 522A. Specifically, FIG. 5A shows a timing diagram where the higher pressure fuel pump stroke duration 520A occurs during a fuel injection 514A. FIG. 5B shows a timing diagram that may occur after step 320A, in FIG. 3, has been implemented. The timing of injection pulse 514B is adjusted to allow the higher pressure fuel pump stroke duration 520B to occur between the fuel injection pulses 512B and 514B, respectively. In another example (not shown), the fuel pulse width FPW is adjusted to allow the higher pressure fuel pump stroke to occur between the fuel injection pulses.

Figure 6A:
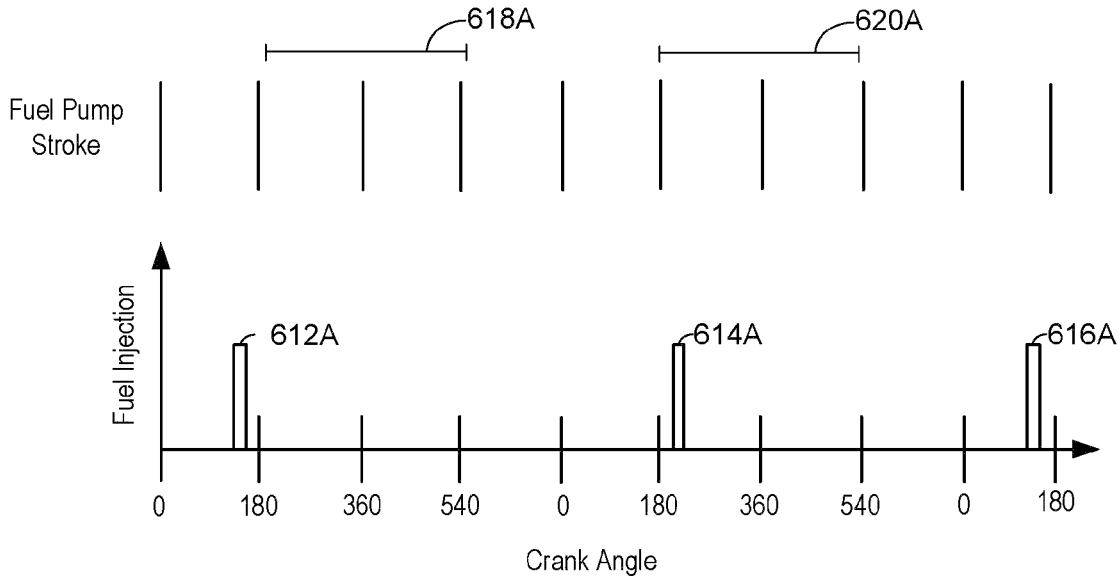
FIG. 6A shows a timing diagram of actuation of a fuel pump and injection profile for an internal combustion engine where a higher pressure pump stroke occurs during a fuel injection pulse.
Figure 6B:
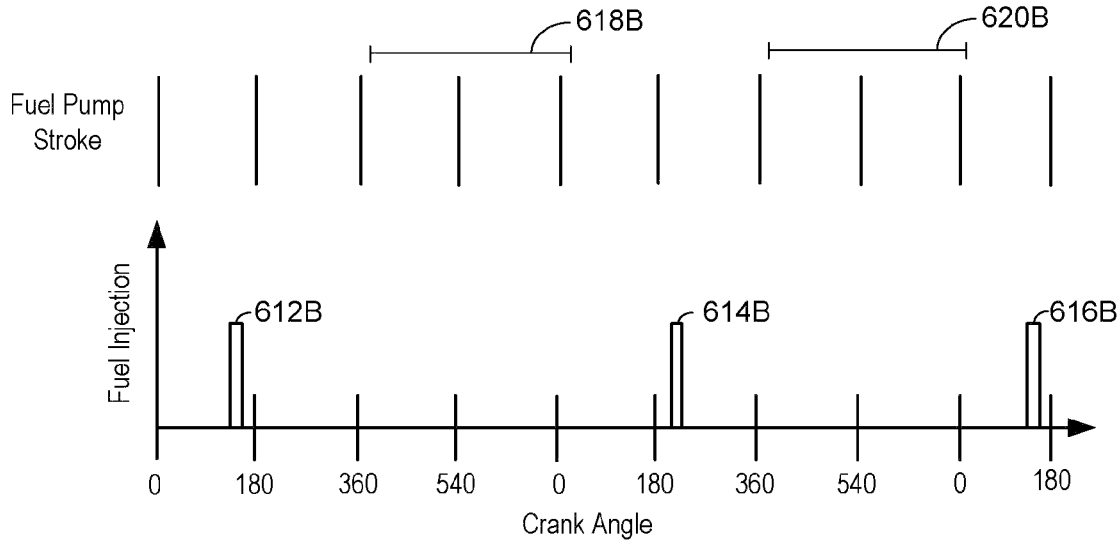
FIG. 6B shows an alternate timing diagram where the timing of the higher pressure pump stroke is adjusted, allowing the higher pressure pump stroke to occur between fuel injection pulses.

In another example, shown in FIGS. 6A and 6B, timing charts are shown that illustrate how the actuation of the higher pressure fuel pump may be adjusted, allowing the high pressure fuel pump stroke to occur between fuel injections. FIG. 6A shows a timing diagram with fuel injection pulses 612A, 614A, and 616A and higher pressure pump stroke durations 618A and 620A, where the higher pressure pump stroke duration 620A occurs during fuel injection 614A. In FIG. 6B the timing of the higher pressure pump stroke duration 620B is adjusted, allowing the higher pressure pump stroke duration 620B to occur between the fuel injection pulses 614B and 616B, as shown at step 320B, in FIG. 3.

Figure 4:
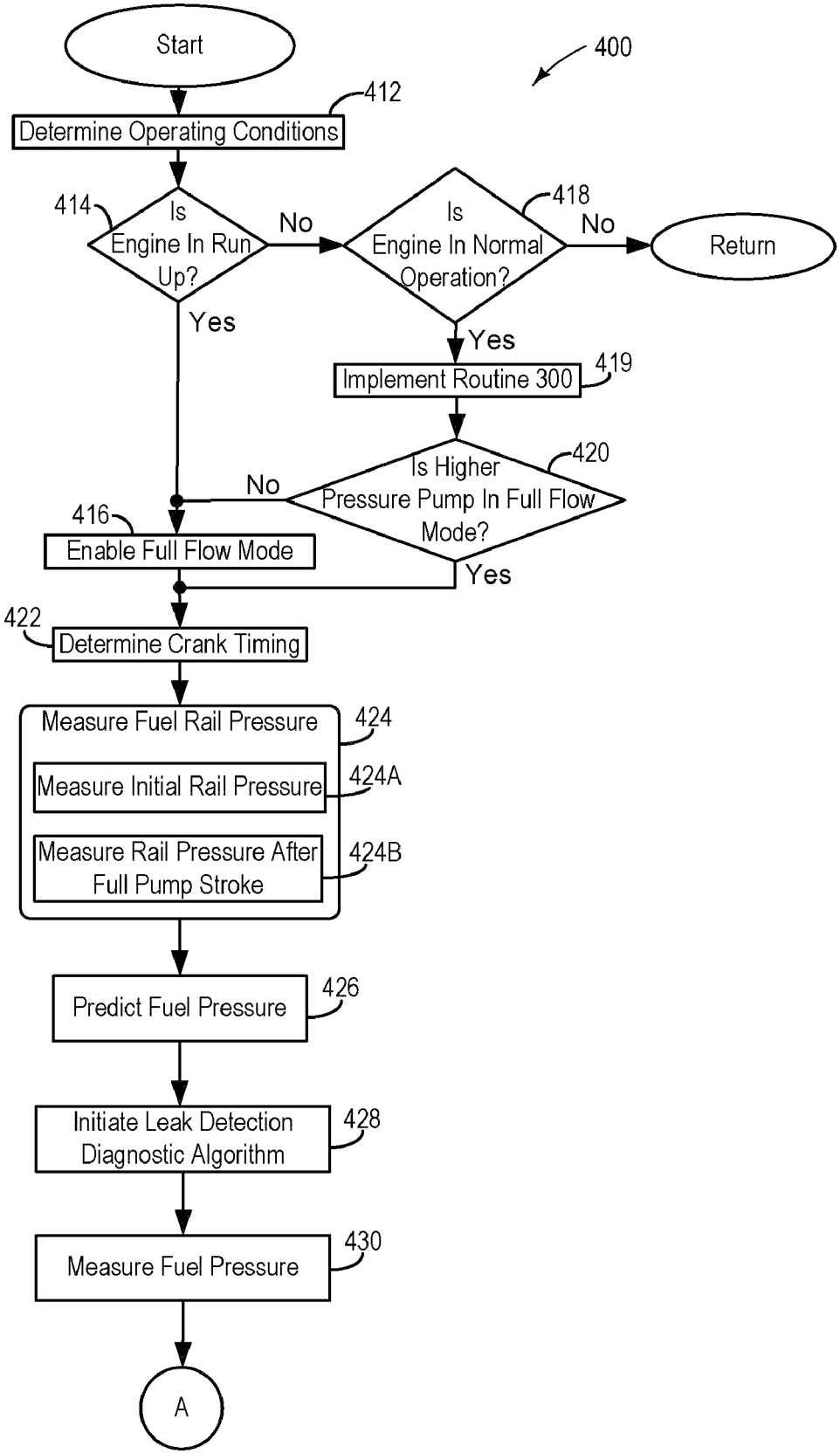
FIG. 4 shows a flow chart that may be implemented to perform diagnostics of the fuel delivery system.
Figure 4:
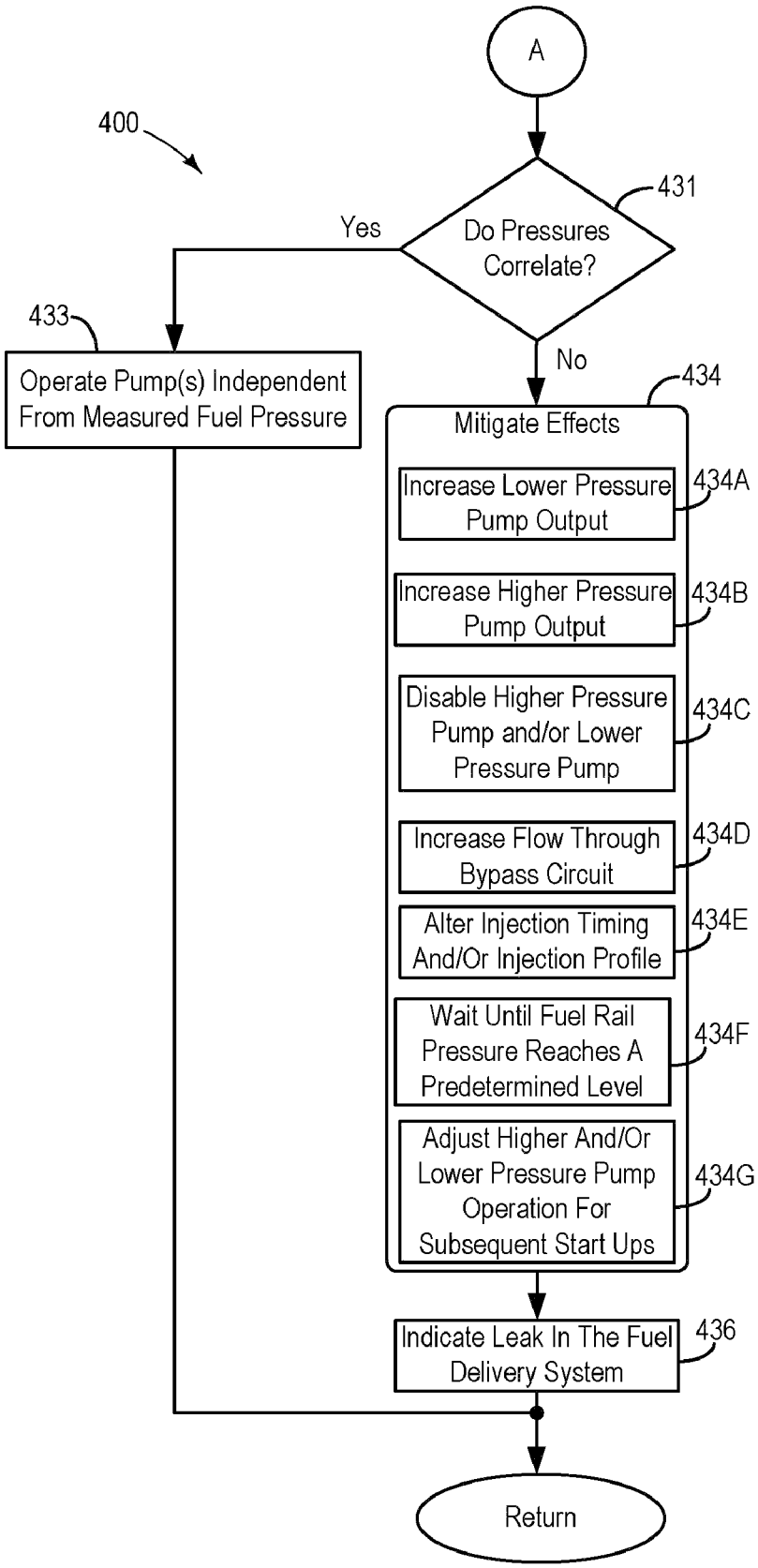

FIG. 4 shows a flow chart, method 400, that may be implemented to increase the accuracy of the fuel delivery system. By implementation of method 400 it is possible to accurately and robustly respond to various engine starting situations including vapor formation, leaks, etc. Furthermore, method 400 may be implemented to perform diagnostics on the fuel delivery system. The fuel delivery system diagnostics may determine if the fuel delivery system is experiencing leak(s) and then take actions to mitigate the effects of the leak(s). Method 400 may be implemented during cranking, engine starting, engine deceleration, or during normal operation of the engine. Normal operation of the engine may include as any time after engine starting and before engine deceleration when the engine is producing torque.

At 412 the operating conditions of the vehicle are determined. The operating conditions include: crank angle, key position, vehicle acceleration, desired injection pressure, fuel rail pressure etc.

The method then proceeds to 414, where it is determined if the engine is in run up. Engine run up includes the time interval when the engine speed is ramping up from crank speed to the idle speed. In an additional or alternative example, it is determined if the fuel rail pressure is less than 3 MPa. In other examples, it is determined if the engine is in deceleration fuel shut off DFSO.

If it is determined that the engine is in run up and/or the fuel rail pressure is less than 3 MPa, the method advances to 416, where a full flow mode of the higher pressure fuel pump is enabled. In this way the higher pressure fuel is adjusted based on engine starting conditions. In other examples the higher and/or lower pressure fuel pumps may be adjusted based on engine starting conditions. A full flow mode includes driving the high pressure fuel pump at full stroke (max stroke). Additionally or alternatively, actuation of the lower pressure pump may be adjusted. In this way the pump operation of at least one pump is adjusted during engine starting based on engine starting conditions.

On the other hand, if the engine is not in run up and/or not below 3 MPa, the method advances to 418 where it is determined if the engine is running under normal operation conditions. Normal operation conditions include conditions when the engine is producing torque and after reaching a stabilized idle speed. If the engine is not operating under normal conditions, the method returns to the start.

However, if the engine is running under normal operating conditions, the method advances to 419 where routine 300 is implemented in order to adjust the fuel delivery system so the fuel rail pressure can be more accurately measured during normal operation. In other examples step 419 may be removed and routine 300 may be implemented before method 400 is implemented.

The method then advances to 420 where it is determined if the higher pressure fuel pump is in a full flow mode. Full flow mode includes driving the higher pressure pump at full stroke (max stroke). If the higher pressure pump is not in a full flow mode the method advances to 416 where a full flow mode is enabled.

The method then advances to 422 where the crank timing is determined, such as based on the rotational speed of the crank shaft. In some examples, the crank timing is determined by Hall Effects Sensor 118. In other examples, another suitable crank angle sensor is used to determine the crank timing such as a variable reluctance sensor. Alternatively, if full flow has already been enabled, the method bypasses 416 and advances to 422.

After 422 the method advances to 424, where the fuel rail pressure is measured twice. At 424A, an initial fuel rail pressure is measured. At 424B the fuel rail pressure is measured after a full pump stroke. In other embodiments, the fuel rail pressure may be measured a plurality of times. In yet other embodiments, the fuel pressure may be measured in fuel line 232 or other suitable locations downstream of the higher pressure pump.

The routine then advances to 426, where the fuel pressure rise in the fuel delivery system is predicted. In one example, equation 10 may be used to calculate the predicted pressure rise in the fuel delivery system. In other examples, another suitable equation may be used to predict the pressure rise in the fuel delivery system. The derivation of equation 10 is discussed in more detail herein. A table is provided which defines various parameters used in the derivation. In this example, the volume of the fuel rail and the bulk modulus k are predetermined parameters. However, in another example, the bulk modulus and the volume of the fuel rail values may be calculated.

The ideal gas law can be used to calculate the amount of fuel vapor and/or air vapor in the fuel rail, therefore the initial rail pressure and volume is equal to the rail pressure and volume after the first pump stroke, as shown in equation 1.

The pressure rise in the fuel rail is a function of the amount of fuel pumped into the rail Vr and the bulk modulus of the fuel rail k. The volume of fuel contributing to the fuel rail pressure rise is solved for, as shown in equation 2.

After the first pump stroke in the high pressure fuel pump, the sum of the change in the volume of air $V_{1a}$-$V_{2a}$ and the $\Delta Vf$ should equal the total volume of fuel pumped by the high pressure pump, as shown in equation 3.

Equations 1, 2, and 3 can be used to solve for the volume of air in the fuel rail after the first pump stroke $V_{2a}$, yielding equation 4.

The ideal gas law can be applied to the predicted fuel rail pressure P3 and the rail pressure after the first pump stroke of the higher pressure pump P2, yielding equation 5.

The pressure rise in the fuel rail may be determined as a function of the amount of fuel pumped into the rail Vs and the bulk modulus of the rail k. The bulk modulus of the rail k and the volume of fuel pumped into the rail Vs can be substituted into equation 5. The volume of fuel contributing to the fuel rail pressure rise $\Delta Vf_{23}$ is solved for, as shown in equation 6.

Equations 4, 5, and 6 can be used to solve for predicted volume of air in the fuel rail $V_{3a}$, yielding equation 7. Some substitutions can be made to equation 7, yielding the quadratic equation shown in equation 8.

The predicted fuel rail pressure can be solved for, yielding 2 solutions, shown in equations 9 and 10. The inventors have found that only the positive solution is valid so equation 10 is used to solve for the predicted fuel rail pressure P3.

| | |
|---|---|
| P1 | Initial Fuel Rail Pressure |
| P2 | Fuel Rail Pressure After First Pump Stroke |
| P3 | Predicted Fuel Rail Pressure |
| Vr | Volume Of The Fuel Rail (Predetermined) |
| Vs | Total Volume Of The Pumped Fuel |
| $\Delta Vf_{12}$ | Volume Of Fuel Contributing To Fuel Rail Pressure Rise |
| k | Bulk Modulus Of The Fuel Rail (Predetermined) |
| $V_{1a}$ | Initial Volume Of Air In The Rail |
| $V_{2a}$ | Volume Of Air In The Fuel Rail After The First Pump Stroke |
| $V_{3a}$ | Predicted Volume Of Air In The Fuel Rail |
| $\Delta Vf_{23}$ | Predicted Volume Of Fuel Contributing To The Fuel Rail Pressure Rise |

$$P1V_{1a} = P2V_{2a} \quad (1)$$

$$\Delta Vf_{12} = (P2 - P1) * Vr/k \quad (2)$$

$$\Delta Vf_{12} + (V_{1a} - V_{2a}) = Vs \quad (3)$$

$$V_{2a} = Vs*P1/(P2 - P1) - P1*Vr/k \quad (4)$$

$$P3V_{3a} = P2V_{2a} \quad (5)$$

$$\Delta Vf_{23} = (P3 - P2) * Vr/k \quad (6)$$

$$V_{3a} = V_{2a} * P2/P3 \quad (7)$$

$$P3^2 * Vr/k - P3((P2 * Vr/k) + Vs - V_{2a}) - V_{2a} * P2 = 0 \quad (8)$$

$$P3 = \frac{((P2*Vr/k) + Vs - V_{2a}) \pm \sqrt{((P2*Vr/k) + Vs - V_{2a})^2 - 4*(Vr/k)*(-V_{2a}*P2)}}{2*(-V_{2a}*P2)} \quad (9)$$

$$P3 = \text{predicted pressure} = \frac{((P2*Vr/k) + Vs - V_{2a}) + \sqrt{((P2*Vr/k) + Vs - V_{2a})^2 - 4*(Vr/k)*(-V_{2a}*P2)}}{2*(-V_{2a}*P2)} \quad (10)$$

Following the prediction of the fuel rail pressure, at 428, a leak detection diagnostic algorithm is initiated. The method then advances to 430, where a plurality of fuel rail pressure measurements are taken over a duration of time, allowing for greater acquisition of data, increasing the accuracy of the system. In other examples, fuel pressure measurements at other location in the fuel delivery system may be taken. In particular, more information may be acquired about the specific interaction between the higher and lower pressure pumps, increasing the accuracy of both the higher pressure pump and the lower pressure pump. The plurality of fuel rail pressures may be taken during engine starting. In other examples, other suitable fuel pressure measurements may be taken at other locations in the fuel delivery system. For example the fuel pressure may be measured in fuel line 232, fuel line 224, etc.

The method then proceeds to 431, where it is determined if the measured pressure of the fuel rail correlates to the predicted pressure (i.e. expected response) of the fuel rail.

The measured pressure in the fuel rail and the predicted pressure of the fuel rail may be correlated a number of different ways. Firstly, a single pressure measurement and an expected (i.e. predicted) pressure calculation may be compared, if the difference between the measured pressure and expected pressure lie within an acceptable range, the pressures are said to be correlated. The acceptable range may be calculated based on uncertainty in the pressure sensor(s), uncertainties in the expected pressure calculation, as well as other parameters such as engine temperature, compliance of fuel line 232, etc. The acceptable range may be a predetermined value or may be calculated each time method 400 is implemented. Secondly, average values of the measured fuel rail pressure and the calculated fuel rail pressure over a specific time interval may be compared. If the average value lies within an acceptable range, the pressures are said to be correlated. The average value may be determined based on various parameters such as the uncertainties in the pressure sensor(s) as well as other parameters such as engine temperature and/or pumping efficiency. Thirdly, a weighted average of the measured and expected pressures may be compared. Again, if the average value lies within an acceptable range the pressures are said to be correlated. In even other examples, a regressive curve fitting algorithm may be applied to both the measured pressures and expected pressures. Then after the regressive curve fitting algorithm is applied to the pressure profiles, the profiles of the curves may be compared to determine if the measured and expected values correlate. It can be appreciated by someone skilled in the art that other suitable methods may be used to determine if the measured pressure(s) and the expected pressure(s) correlate.

In the case where the fuel delivery system is not experiencing leaks but the fuel rail has fuel vapor in it, the fuel vapor collapses as soon as pressure is built up in the fuel rail and the pressure is above the vapor pressure line of the fuel at the operating temperature. In this case, the first stroke pressure rise may not be very high, but the pressure response will return to the correlated pressure rise rate after the vapor collapses. Although there may be short transient drops in pressure due to the fuel vapor, the expected response can anticipate such effects. As such, even during such conditions, the pressure response may still correlate to the expected response a fuel delivery system with fuel vapor.

Additionally, under some conditions a small leak may appear to be a loss in the higher pressure pump's efficiency. In one embodiment, a leak from an inefficient high pressure pump may be separated from an external leak by determining if the pressure in the fuel rail rises at a constant rate per stroke. If it is determined that the pressure response in the fuel rail rises at a constant rate per stroke, it is indicates that a change in the efficiency of the higher pressure pump has occurred, and the measured fuel rail pressure and predicted fuel rail pressure may still be correlated. The slope of the pressure build line may indicate the efficiency of the higher pressure pump. However, if it is determined that the pressure response in the fuel rail does not rise at a constant rate per stroke, it is determined that the measured fuel rail pressure rise and the predicted fuel rail pressure rise are uncorrelated.

If the measured pressure in the fuel rail correlates to the calculated pressure (e.g. expected response) in the fuel rail, the routine proceeds to 433 where the operation of one or more pumps is carried out independently from the measured pressure in the fuel rail. In this way the operation of the higher and/or lower pressure fuel pumps can be further adjusted independent of measured fuel pressure in response to an expected correlation. In this example, step 433 may include enabling crank fueling if the engine is in run up.

However, if it is determined that the measured pressure and calculated (expected) pressure does not correlate, the system may be experiencing leaks, the method proceeds to 434 where actions are taken to mitigate the effects of the leaks in the fuel delivery system. The actions taken to mitigate the effects of the leak in the fuel delivery system may include any of the following actions: increase the output of the lower pressure pump 434A, increase the output of the higher pressure pump 434B, disable the lower pressure pump and/or higher pressure pump 434C, increase flow through the bypass circuit 434D, alter injection timing and/or injection profile 434E, wait until the pressure in the fuel rail has reached a predetermined level 434F, adjust the higher and/or lower pressure fuel pump operation for subsequent start ups 434G. In this way the operation of one or more of the pumps may be adjusted based on measured fuel pressure when the pressure rise is not correlated to the expected response. The method may then proceed to 436 where it is indicated that there is a leak in the fuel delivery system. Then the method ends. In other alternate examples, the method may return to the start.

Through implementation of method 400 a leak may be detected in the fuel delivery system and in response to adjust various operation of the fuel delivery system to mitigate the effects of the leak, thereby increasing the accuracy of the fuel delivery system and increasing the efficiency of the engine, while decreasing emissions.

In another embodiment, it may be determined if a specific component, such as the higher pressure pump or the lower pressure pump, has degraded and take actions to disable that particular component. Additionally, an indication may be made that the specific component has degraded. The indication may be in the form of a light located on the dash or may be a signal stored in controller 12. In other examples, the indicator may be a warning sound or other suitable indicator.

Figure 7:
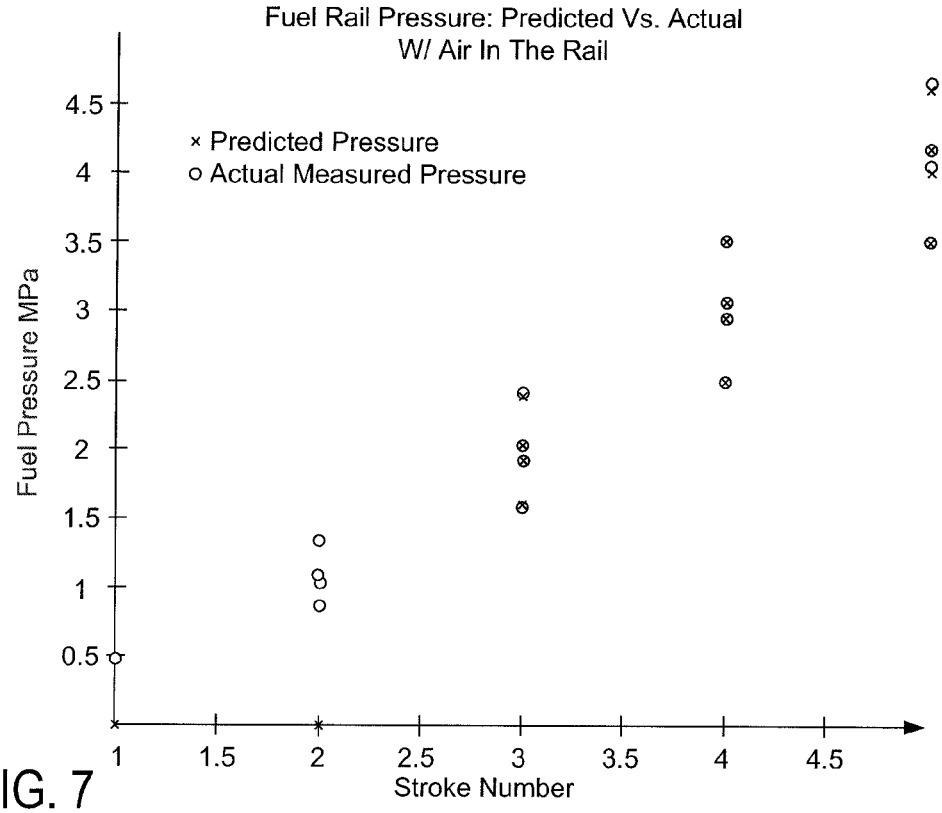
FIG. 7 shows a graphical depiction of the actual vs. predicted fuel pressure rise in a fuel delivery system that is not experiencing a leak.

FIG. 7 shows a graph depicting the variations between the predicted fuel rail pressure and the actual fuel rail pressure in a fuel delivery system that is not experiencing leaks during start up. Note that the predicted fuel rail pressure for the first two pump strokes is 0, because during the first two pump strokes the predictive algorithm, shown in FIG. 4, is in the process of being executed, therefore no prediction may be carried out.

Figure 8:
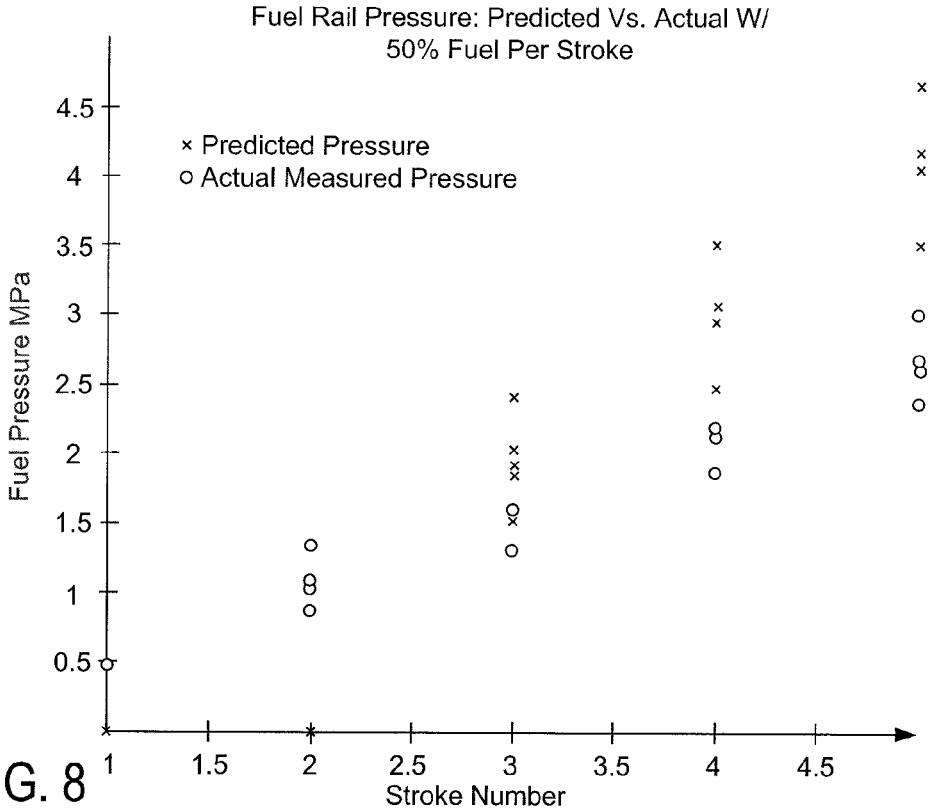
FIG. 8 shows a graphical depiction of the actual vs. predicted fuel pressure rise in a fuel delivery system experiencing a leak.

FIG. 8 shows a graph depicting the variation between the predicted fuel rail pressure and the actual fuel rail pressure in a fuel delivery system that is experiencing leaks during start up. The fuel delivery system graphically depicted in FIG. 8 can only deliver 50% fuel per stroke, when compared to the fuel delivery system that is not experiencing leaks. The predicted (i.e. expected) fuel rail pressure rise is much slower than the actual fuel rail pressure rise. The error between the predicted vs. actual fuel rail pressure can be used to determine if there is a leak in the fuel delivery system. The leak detection may be carried out by the method shown in FIG. 4.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating a fuel delivery system with a first pressure pump fluidly coupled to a second higher pressure pump and a fuel rail, comprising:

adjusting pump operation of at least one of the first and second pumps during engine starting, the adjustment based on engine starting conditions;

when a measured fuel pressure rise during the engine starting is correlated to an expected response, further adjusting pump operation independent of the measured fuel pressure during the engine starting; and when the measured fuel pressure rise during the engine starting is not correlated to the expected response, further adjusting pump operation based on the measured fuel pressure during the engine starting.

2. The method of claim 1 further comprising adjusting a first injection during cranking responsive to the expected response and an actual response of the measured fuel pressure.

3. The method of claim 2 wherein, when the measured fuel pressure rise is less than the expected response, the adjusting further includes disabling at least one of the first and second pumps.

4. The method of claim 2 further comprising indicating a fuel delivery system leak in response to pressure rise during engine starting being less than the expected response, the method further comprising differentiating between a loss in the higher pressure pump efficiency and a leak in the fuel delivery system, the differentiation responsive to a rate of pressure rise per pump stoke of the higher pressure pump.

5. The method of claim 1 wherein the engine starting conditions include the injection timing, injection profile, and/or crank timing.

6. The method of claim 5 wherein adjusting pump operation of at least one of the first and second pumps during engine starting includes adjusting the pump stroke of the second pump.

7. A fuel delivery system for an internal combustion engine comprising:

a lower pressure pump;

a higher pressure pump fluidly coupled downstream of the lower pressure pump;

a fuel rail fluidly coupled downstream of the higher pressure pump;

one or more fuel injectors fluidly coupled downstream of the fuel rail;

a sensor fluidly coupled between the higher pressure pump and the fuel injector(s);

and a controller electronically coupled to the fuel delivery system, where the controller adjusts the timing of a fuel injection relative to the actuation of the higher pressure pump so that the fuel injection occurs between pump strokes of the higher pressure pump, and when the expected pressure rise downstream of the higher pressure pump and measured pressure rise correlate with one another, adjusts one or more of the fuel pumps independent of the measured pressure, and when the expected pressure rise and measured pressure rise do not correlate with one another, adjusts one or more of the fuel pumps in response to the measured pressure rise.

8. The fuel delivery system of claim 7 wherein the expected pressure rise is calculated utilizing various parameters which includes two or more fuel rail pressure measurements.

9. The fuel delivery system of claim 8 wherein, the fuel rail pressure measurements are taken between higher pressure pump strokes.

10. The fuel delivery system of claim 7 wherein an indication is made that the fuel delivery system is experiencing leaks when the expected pressure rise and the measured pressure rise do not correlate.

11. The fuel delivery system of claim 10 wherein correlation includes a difference between the expected and measured pressure being less than a predetermined value and non-correlation includes the difference between the expected and measured pressuring being larger than a predetermined value.

12. The fuel delivery system of claim 7 wherein one or more of the pumps is disabled when the expected pressure rise does not correlate to the measured pressure rise.

13. The fuel delivery system of claim 7 wherein pump operation for subsequent engine starts is adjusted in response to the correlation.

14. The fuel delivery system of claim 7 wherein the controller adjusts the timing of the fuel injection when all engine cylinders are carrying out combustion.

15. A fuel delivery system for an internal combustion engine comprising:

a lower pressure pump;

a higher pressure pump fluidly coupled downstream of the lower pressure pump;

a fuel rail fluidly coupled downstream of the higher pressure pump;

one or more fuel injectors fluidly coupled downstream of the fuel rail;

a sensor fluidly coupled between the higher pressure pump and the fuel injector(s); and a controller electronically coupled to the fuel delivery system;

wherein during an engine start, the controller operates one or more fuel pumps in response to an engine starting condition, and when an expected fuel pressure rise downstream of the higher pressure pump and a measured fuel pressure rise correlate with one another, adjusting the one or more fuel pumps independent of the measured fuel pressure during the engine start, and when the expected fuel pressure rise and the measured fuel pressure rise do not correlate with one another, adjusting the one or more fuel pumps in response to the measured fuel pressure rise during the engine start.

16. The fuel delivery system of claim 15 wherein crank fueling is enabled when the expected fuel pressure rise is correlated to the measured fuel pressure rise.

17. The fuel delivery system of claim 16 wherein the crank fueling is delayed when the expected fuel pressure rise does not correlate to the measured fuel pressure rise.

18. The fuel delivery system of claim 15 wherein the operations of the controller are further carried out during engine run up or during engine deceleration fuel shut-off.

19. The fuel delivery system of claim 18 wherein the correlation is determined after a full pressure pump stroke.

20. The fuel delivery system of claim 19 wherein operation of one or more pumps during subsequent start ups is adjusted in response to the correlation.

* * * * *